United States Patent [19]

Seifert

[11] Patent Number: 4,907,750

[45] Date of Patent: Mar. 13, 1990

[54] HAMMERMILL

[75] Inventor: Horst H. Seifert, Darian, Ill.

[73] Assignee: Prater Industries, Inc., Chicago, Ill.

[21] Appl. No.: 165,962

[22] Filed: Mar. 9, 1988

[51] Int. Cl.[4] ..... B02C 13/282

[52] U.S. Cl. ..... 241/73; 241/74; 241/189 R; 241/285 B

[58] Field of Search ..... 241/285 R, 73, 285 A, 241/74, 285 B, 194, 195, 189 R

[56] References Cited

U.S. PATENT DOCUMENTS

| | | | |
|---|---|---|---|
| 1,339,950 | 5/1920 | Fowler | 241/285 B X |
| 1,666,797 | 4/1928 | Snyder | 241/73 |
| 2,426,346 | 8/1947 | Feight | 241/285 B X |
| 2,756,002 | 7/1956 | Brake | 241/285 B |
| 2,816,716 | 12/1957 | Webb | 241/285 B X |

FOREIGN PATENT DOCUMENTS

| | | | |
|---|---|---|---|
| 15197 | 9/1980 | European Pat. Off. | 241/73 |
| 2047120 | 11/1980 | United Kingdom | 241/194 |

*Primary Examiner*—Mark Rosenbaum
*Attorney, Agent, or Firm*—Lee, Mann, Smith, McWilliams & Sweeney

[57] ABSTRACT

A hammermill in which the housing is a dust leakage free integral bonded together assembly of plates including spaced apart front and back or rear plates between which are disposed side plates whereby the hammermill chamber is defined, a hammer carrying rotor removably mounted within the hammermill chamber and secured for ease of removal from its drive shaft that is journaled by a single bearing arrangement mounted in the housing rear or back plate for insuring smooth running even after wear, a screen arrangement removably mounted within the housing hammermill chamber radially outwardly of the rotor, centered with respect thereto and providing a high screen area to horsepower ratio, with the screen being segmented to define two major screen sections that are removably seated against annular and congruently aligned rings that are affixed to the respective housing front and rear walls, with the rotor mounting the hammermill hammers in the usual groups about the axis of same, but by way of a removable pin for each group, and with the hammermill housing front wall being open coextensively with the rotor and screen to define a single housing doorway for easy access, when opened, to the screen, rotor, and its hammers, and a single door hinged to the housing by a single hinge and reinforced for free and easy swinging movement between open and closed positions, whereby when the housing doorway is open, the assembly hammers and screen segments may be readily replaced through the housing doorway without removing the rotor and with minimunized hammermill down time.

11 Claims, 5 Drawing Sheets

10
12
14
16
18
28
30
34
36
38
42
44
46
48
56
58
60
62
64
65
66
68
70
72
74
76
78
82
84
88
90
252
254
256
258

HAMMERMILL

The present invention relates to hammermills, and more particularly to the type of grinder that mounts hammers in a rotor that is operably mounted and rotated within a coaxial screen for size reduction purposes.

Hammermills have long been commonly employed to achieve size reduction of a wide variety of materials by impact. Usually apparatus of this type includes a housing defining a hammermill chamber, an inlet thereto, an outlet therefrom, with a rotor and screen being mounted in the housing hammermill chamber in coaxial relation to the central axis of the chamber that normally extends crosswise of the housing, about which axis the assembly rotor is rotated. The assembly rotor has individual hammers secured thereto in multiple groups; the hammers may be fixed or swingable, a hammermill equipped with swingably hammers being swingably mounted about an axis that parallels the rotational axis of the rotor, with such pivotal axes being located to be equidistant from the rotational axis of the rotor the hammers are mounted in the rotor to dispose their ends in close adjacency to the screen, when the hammermill rotor is rotated, with suitable drive means being employed to rotate the rotor.

Conventionally, hammermill housings have taken the form of a fabricated assembly put together by employing nuts and bolts or the like fasteners requiring massive gasketing to reduce dust leakage during operation of the hammermill. The hammermill screen is mounted in a cradle that is secured about the hammermill housing chamber with the hammermill rotor generally being journaled between spaced bearings on either side of same that are normally mounted in the hammermill housing front or rear or back walls.

Hammermills heretofore have been long employed to effect size reduction in such diverse materials as scrap metal, paper, animal and human feed, or anything else that needs to be reduced in size. Normally, the hammermill in operation involves the hammermill rotor rotating about the axis of the hammermill chamber and thereby sucking air into the machine, with the material, to be sized reduced, coming into the machine from an overhead feeder and thrown by centrifugal force against the screen by the action of the hammermill rotor as well as its hammers. The hammermill screen has a mesh size in accordance with the size reduction desired, and the properly sized material after passing through the screen leaves the hammermill housing through a suitable outlet and is removed from the locale of the hammermill by using suitable air flow inducing or mechanical bulk solid material handling equipment or the like.

Conventionally, the front and rear or back sides of hammermills have one or more ports formed in same for reaching inside the machine to remove and replace the rotor hammers when they are worn. Because of the high speed rate that the hammermill rotor rotates, it is important that the rotor be properly balanced, and for conventional hammermills, great pains heretofore have been taken to properly mount the rotor for this purpose.

The housing of conventional hammermills is equipped with access doors mounted on one or both sides of same, and the rotor is driven from one of the sides of same, with the hammermill door having a pair of hinges that must be accurately located to insure a free swinging movement between open and closed positions. Conventionally, hammermill rotors cannot be removed from the mill without taking the hammermill housing almost completely apart to expose the rotor for this purpose. Further, the mill hammers are difficult and time consuming to replace, even if the mill rotor is removed for this purpose. Consequently, conventional mills are subject to much down time when the mill hammers are to be replaced.

Conventional hammermills are generally regarded as expensive and difficult to operate and maintain, noisy and dust generating in operation, and are known to involve excessive down time to change out the mill hammers and/or its screen.

A principal object of the present invention is to provide a hammermill in which the hammermill housing and rotor are arranged to maximize the ease of replacing the apparatus hammers and screen and yet provide for increased operating efficiency.

Another principal object of the invention is to provide a hammermill in which the hammermill housing defines a single full access doorway that when opened fully exposes the hammermill rotor and screen for convenient replacement of the screen and the rotor hammers, with or without removing the rotor, with the housing doorway being closed by a single free swinging door that is latched in its closed position for hammermill operation and that is single hinge mounted and reinforced for a smooth swinging movement between opened and closed positions.

Yet a further principal object of the invention is to provide a hammermill arrangement in which the rotor is symmetrically built and the journaling arrangement therefor properly centers the rotor within the mill chamber adjacent to the center of gravity of the mill housing for freedom from vibration and whipping of the journaling shaft during operation, with the rotor having a single journaling mounting arrangement in the hammermill housing back or rear wall, with the rotor hammers being mounted in the usual spaced groups about the rotor, and with the hammers of each group of hammers being swingably mounted on a removable pin for ease of replacement of the hammermill hammers.

Yet another object of the invention is to provide a hammermill arrangement in which the groups of hammers that are removably applied to the rotor can be preassembled on a bench or the like positioned adjacent the mill, and then applied in sequence to the mill rotor, as replacement hammer groups, with significant reduction in down time for the mill resulting.

A further principal object of the invention is to provide an improved hammermill screen mounting arrangement that eliminates the need for the conventional screen cradle, with the screen being applied directly to the housing in several curvilinear sections that are positioned to accommodate inflow into the hammermill chamber, as from the top of same, of the material that is being size reduced hammermill fashion, and the screen being subject to a self tightening effect on operation of the mill.

Yet another principal object of the invention is to provide a hammermill of which the housing is an integral welded body having a rear or back wall that forms in effect the main wall of the hammermill that journals the hammermill rotor at a single location in the hammermill and is arranged for crane lift action to move the hammermill, even when the hammermill housing has secured to same the base that also mounts the hammermill rotor motor drive and defines the hammermill sized bulk material receiving chamber. The arrangement of the disclosed embodiment involves the hammermill being placed on a suitable support defining a receiving chamber that may be, in setting up the hammermill for use, arranged for removing the sized material received from the mill, with the hammermill rotor being disposed, on one side of the housing main wall, and the rotor rotating motor and mount therefor being disposed on the other side of the housing main wall so as to make the hammermill assembly involved essentially balanced for efficient crane lift action in moving the hammermill as a whole.

Other objects, uses, or advantages will be obvious or become apparent from a consideration of the following detailed description and the application drawings.

Figures 1, 2:
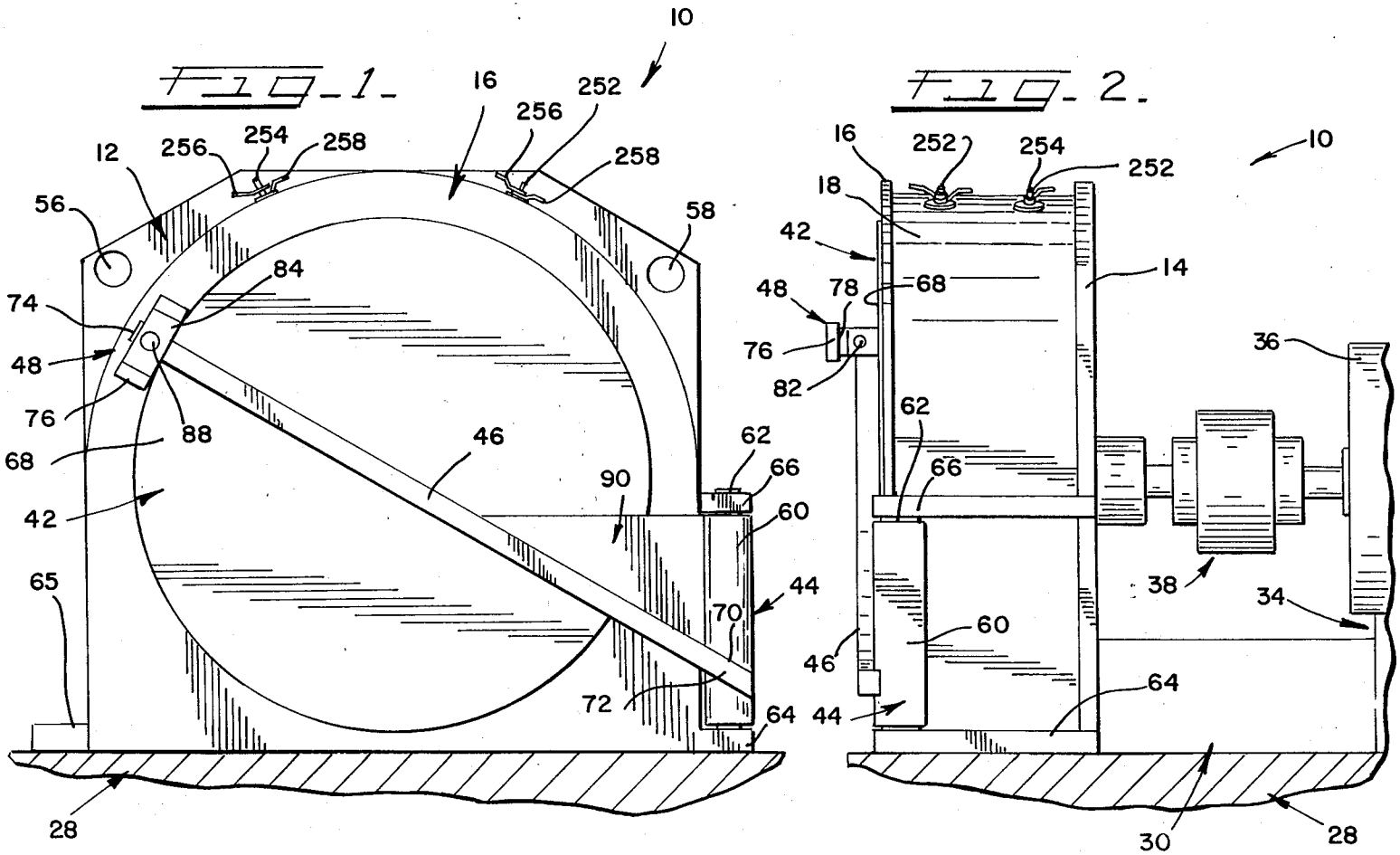
FIG. 1 is a front elevational view of a hammermill assembly, including a mill and motor base therefor, arranged in accordance with the present invention, with the hammermill housing shown with its doorway closed and applied to the mill and motor base that is to underly the hammermill housing and is normally suitably secured to same.
FIG. 2 is a side elevational view of the hammermill assembly arrangement of FIG. 1, taken from the right hand side of FIG. 1, and diagrammatically illustrating the hammermill and motor base as well as a rotor drive for the hammermill involved.
Figures 3, 3A:
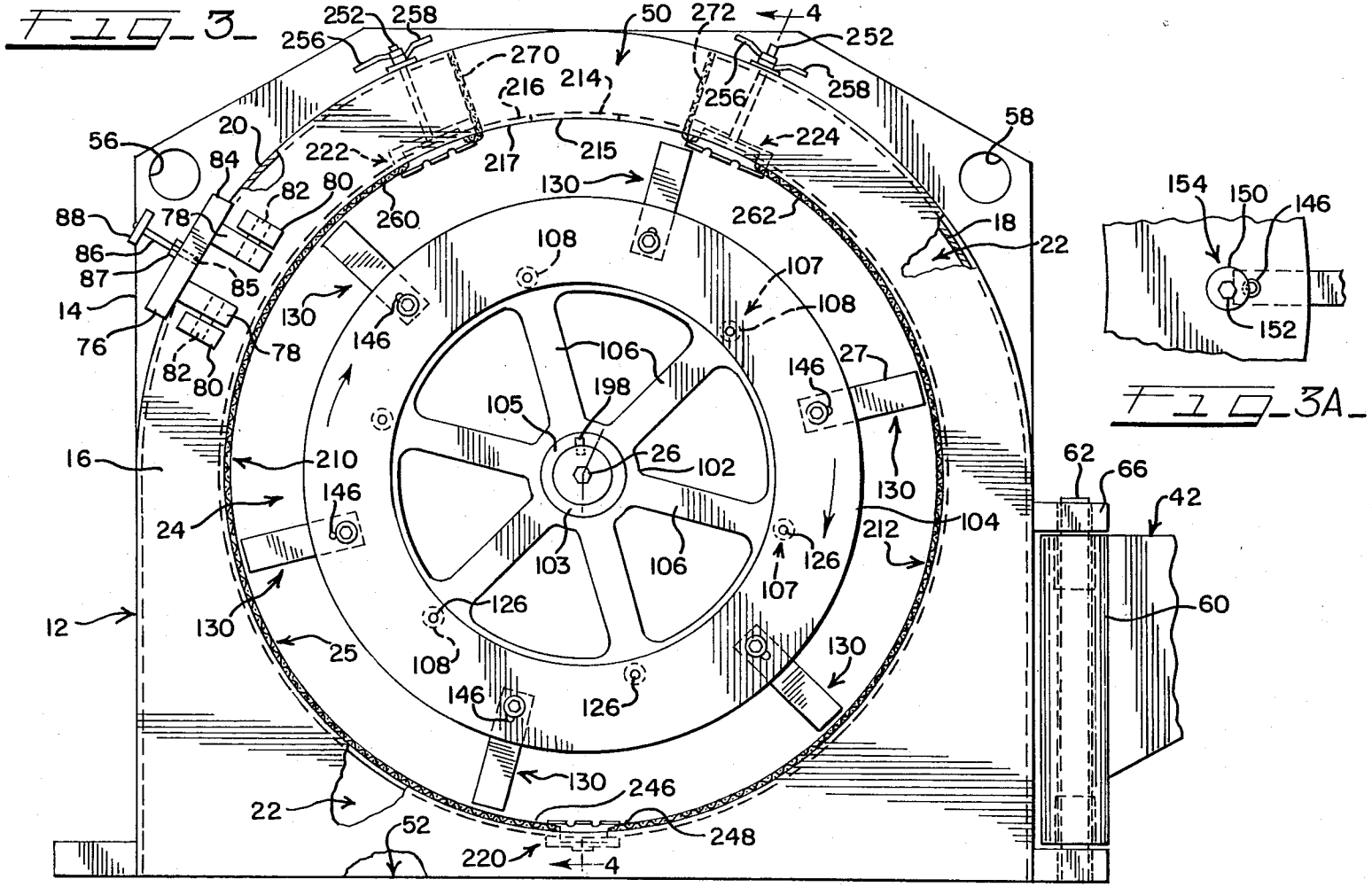
FIG. 3 is a view similar to that of FIG. 1, but on an enlarged scale, showing the hammermill with its housing door swung to the open position to fully expose the hammermill housing chamber, the hammermill rotor and the hammers carried by same, and the hammermill screen, all of which are improved in accordance with the present invention.
FIG. 3A is a fragmental side elevational view of one portion of the exposed face of the hammermill rotor when the hammermill housing door is opened, indicating the manner in which the mounting pin for individual hammers of each group of hammers is releasably mounted at both sides of the hammermill rotor, in accordance the present invention.
Figure 4:
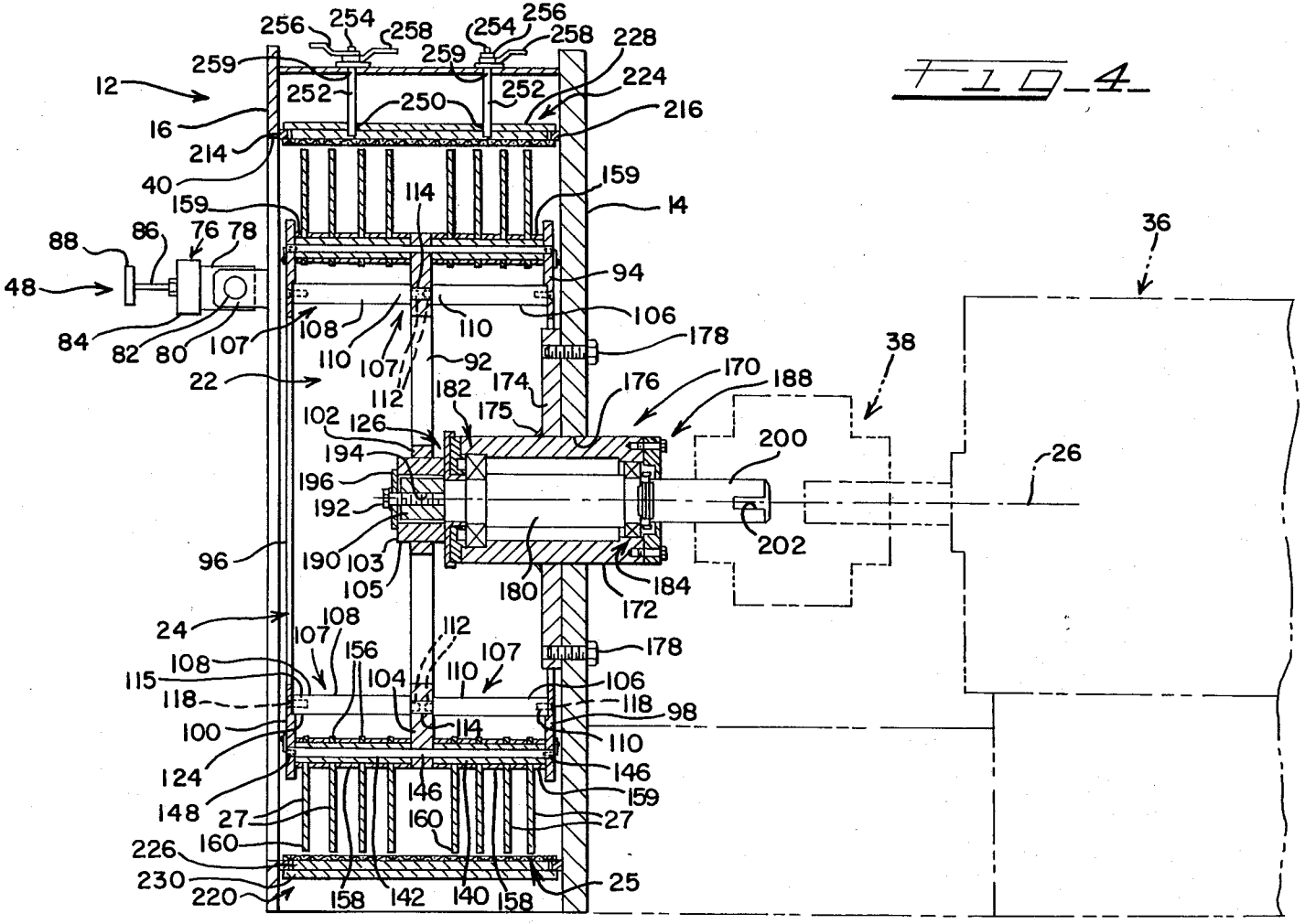
Figure 5:
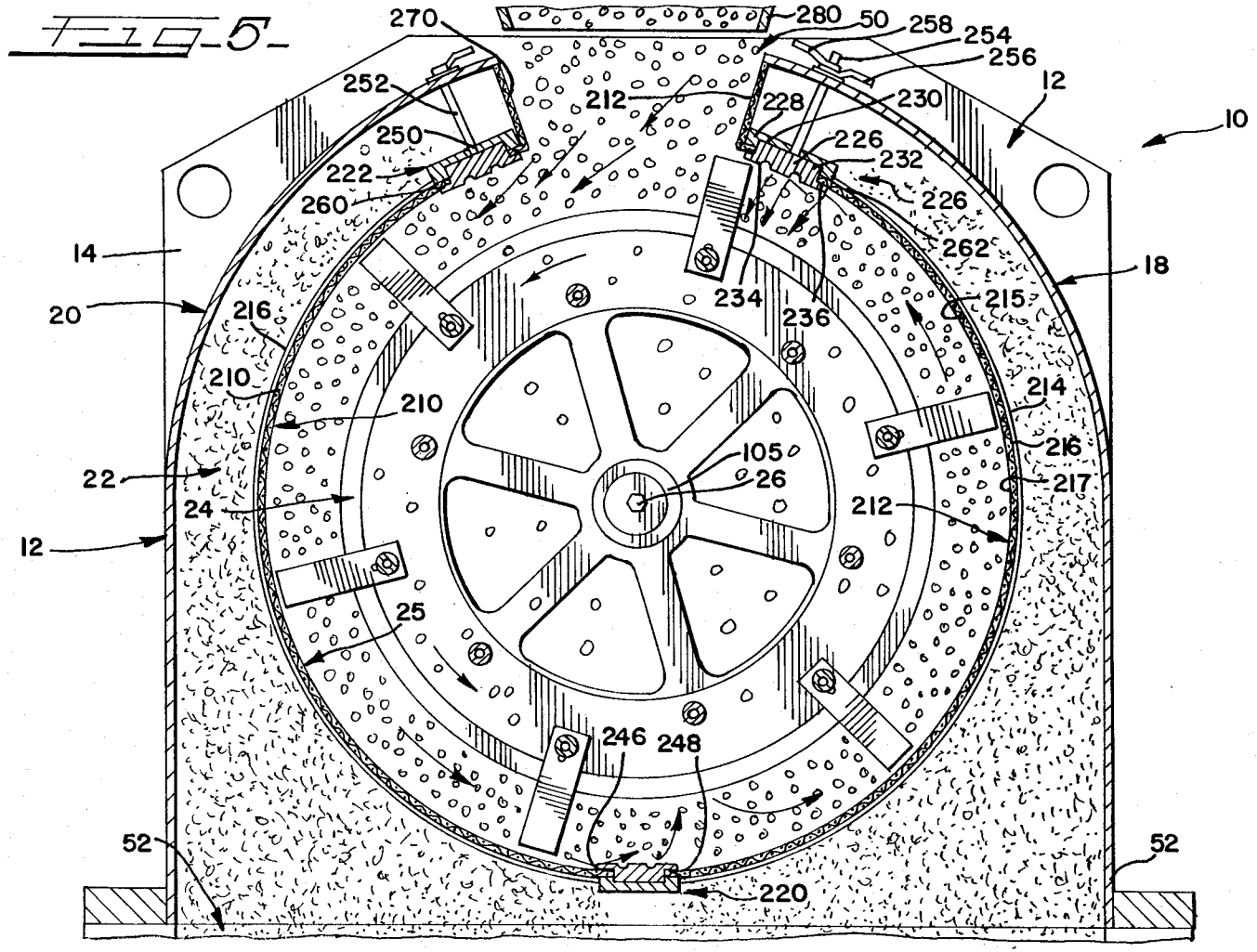
Figure 6:
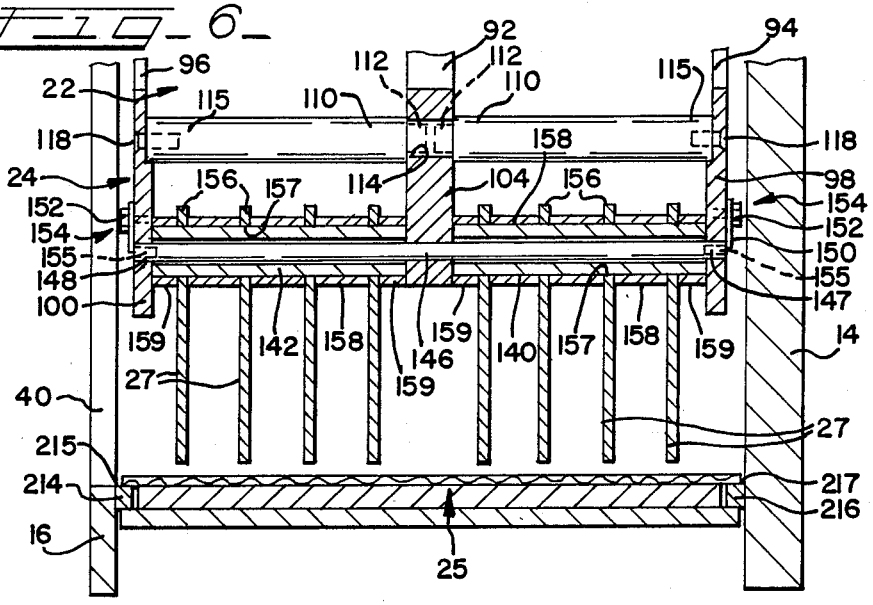
Figure 7:
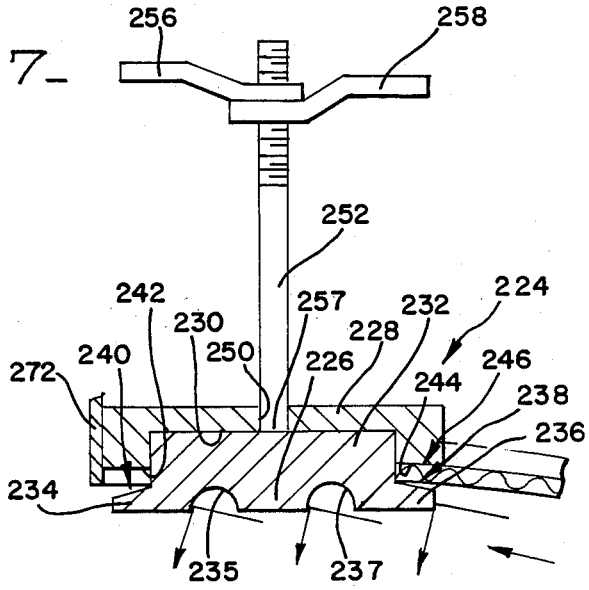
Figure 8:
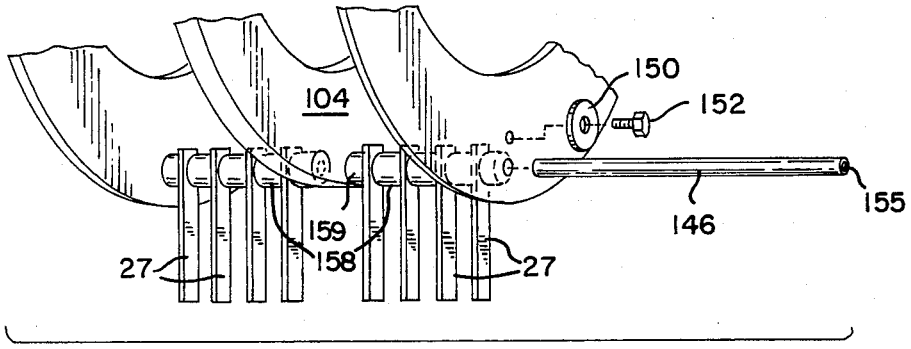

FIG. 4 a transverse cross-sectional view of the hammermill taken essentially along line 4—4 of FIG. 3, showing also in phantom a conventional motor drive and coupling assembly for driving the hammermill rotor with the conventional mill and motor base of FIGS. 1 and 2 being omitted;

FIG. 5 is a view similar to that of FIG. 3, but illustrating particulate matter in the process of entering, being acted on with the hammermill chamber, and leaving said chamber in accordance with the present invention;

FIG. 6 is ah enlarged showing of the portion of the rotor at the lower portion of FIG. 4;

FIG. 7 is an enlarged side elevational view of one of the adjustable screen mounting devices adjacent the hammermill inlet in the showings of FIGS. 3 and 5; and FIG. 8 is a diagrammatic view of a typical hammermill hammer group that is involved in the present invention, as separate from the mill rotor, and with the mounting pin thereof shown displaced from same, and indicating how such pin is applied thereto and removed therefrom.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 of FIGS. 1 and 2 generally indicates a hammermill assembly embodying the improvements of the present invention. Assembly 10 comprises housing 12 including a rear or back plate 14 that for the hammermill apparatus 10 that is illustrated forms in effect the "main" plate of the assembly 10, a front plate 16, and spaced side plates 18 and 20 (see FIG. 3) that are disposed and fixed between the housing back plate 14 and the housing front plate 16 to form the housing hammermill chamber 22 in which operates hammermill rotor 24 that, when the hammermill is operating, rotates about axis 26 that extends crosswise of the hammermill chamber 22 and is essentially horizontally disposed when the hammermill assembly 10 is operably mounted on a suitable floor structure 28 (see FIGS. 1 and 2), or its equivalent, equipped conventionally with suitable bulk solid material handling equipment to receive from the mill 10 by gravity discharge the sized material and convey such material away from the mill 10, as to a point of packaging or use. The hammermill housing 12 may be suitably affixed to conventional mill and motor base 30 that includes a suitable motor mount 34 to which is applied conventional drive motor 36 for driving the rotor 24 at an appropriate hammermill speed through conventional coupling 38 (see FIG. 2).

The hammermill housing front plate 16 defines a single access opening 40 (see FIG. 4) that is coextensive with the rotor 24, its hammers 27 when extended during the usual hammermill operation, and screen 25. The access opening 40 is closed by a single door 42 hinged to the housing 12 by a single hinge device 44 which in accordance with the invention is reinforced by cross bar 46 having securement latch device 48 for locking the door in its closed position (the position of FIGS. 1 and 2) when the hammermill apparatus 10 is to operate as such.

The hammermill housing 12 in the form shown defines inlet 50 (see FIGS. 3 and 5) to the hammermill chamber 22 and an elongate outlet 52 (see FIG. 5) therefrom that is open to the conventional chamber of support 28 in which bulk material handling apparatus of a conventional type is suitably mounted for conveying the sized bulk material away from mill 10, as to a point of packaging or use, etc. The outlet 52, as indicated in FIG. 5, extends between the hammermill housing side plates 18 and 20 at the hammermill housing base 55 for gravity feed of the resized material from mill 10.

THE HAMMERMILL HOUSING

The hammermill housing back or rear plate 14, front plate 16 and side plates 18 and 20 are suitably bonded together, as by employing suitable welding techniques, as distinguished from the nut and bolt or the like type fabrication techniques, and the massive gasketing techniques, heretofore employed in connection with hammermill housings. The plates forming housing 12 are fully welded together so as to fully fill all joints between and defined by same with weld metal to avoid dust leakage and effect noise suppression during operation.

Further, the housing back or rear plate 14 is arranged to be the "main" plate of the assembly 10 as housing 12 is applied to base 30, whereby when suitable cable hooks are applied to crane lift apertures 56 and 58 that are formed in the plate 14 to either side of axis 26, the hammermill assembly 10 is essentially balanced for effective crane lift operation in being moved, due to the arrangement of the mass of the housing 12, and its motor base 30 in defining the motor mount 34, as well as the motor 36 and coupling 38 as applied thereto.

As indicated, the access opening 40 defined by the front plate 16 is coextensive both with the rotor 24 and screen 25 and thus fully exposes both these components of the hammermill apparatus 10, when the hammermill apparatus housing door 42 is released and swung to the open position suggested by FIG. 3.

The hinge device 44 comprises an elongate cylindrical member 60 (see FIGS. 1 and 2) receiving a pivot shaft 62 that extends therethrough as well as the housing lower lug 64 and the upper brace bar 66 that are fixed (as by welding) between the housing plates 14 and 16 at the right side of the apparatus 10 as shown in FIGS. 1 and 2. The lug 64 and its companion lug 65 on the other side of the apparatus 10, which is also fixed between the housing back plate 14 and front plate 16, are employed to suitably weld or otherwise bond the motor base 30 to housing 12 in a dust leakage free manner.

The reinforcing bar 46 is welded both to the door external surface 68 as well as to slot 70 of the cylindrical member 60 in which the bar end 72 is received. The bar 46 terminates in free end 74 with which the latch device 48 is associated. As indicated in FIGS. 1–4, the device 48 comprises a U-shaped member 76 having its legs 78 pivotally connected to and between spaced lugs 80 (see FIG. 3) by the respective pivot pin 82, with the bridge portion 84 of member 76 being apertured at 85 (see FIG. 3) to receive an externally threaded shank 86 that is threadedly received in nut 87 (fixed by welding to member 76 in centered relation to the shank receiving aperture 85). Shank 86 has suitable handle 88 so that it may be turned against the bar 46 at its end 74 for latching purposes, utilizing the handle 88, to set the housing door 42 in its access opening closing relation. By retracting the threaded shank 86 to the position of FIG. 4, and swinging the U-shaped member 76 ninety degrees upwardly of the showing of FIG. 1 (see FIG. 3), thus to fully expose the apertured end portion 74 of the reinforcing rod 46, the door 42 is released for moving it to the rotor and screen exposing relation shown in FIG. 3.

For additional reinforcement purposes, gusset plate 90 (see FIG. 1) is welded between the hinge member 60 and reinforcing rod 46, whereby the housing door 42 is operably mounted by way of a single hinge to smoothly swing between the fully opened and the fully closed positions.

THE HAMMERMILL ROTOR AND ITS JOURNALING

The rotor 24 itself generally comprises a center plate 92 and side plates 94 and 96 arranged and united to provide a rotor that is symmetrical about axis 26 and does not require machining for proper centering with respect to the axis 26.

As indicated in FIGS. 4 and 6, the rotor center plate 92 is approximately twice as thick as side plates 94 and 96. The side plates 94 and 96 are in the form of annular discs 98 and 100 while the center plate 92 includes center portion 102 and rim portion 104 that are joined together by a plurality of integral arms 106 (see FIG. 3). Sleeve 103, centered within the center plate center portion 102 and welded in place, forms the hub 105 of the rotor 24. The plates 92, 94 and 96 are separate by respective sets 107 of spacer pins 106 and 108. As indicated in FIGS. 4 and 6, the spacer pins 106 and 108 have their similar ends 110 each formed to define a stud 112 that for each spacer pin set 107 are received in the respective apertures 114 defined by the center plate rim portion 104, and their other ends 115 are secured to the respective plates 94 and 96 by suitable flat head screws 118.

The rotor 24 in the form shown swingably mounts the individual hammers 27 in individual groups in equally spaced relation about rotor 24. While the number of groups supplied to any particular rotor 24 in terms of number is optional, six groups 130 are shown in the illustrated embodiment (see FIG. 3). The number of hammers 27 applied to any particular group is also optional, and will depend on the width of the rotor 24 and thus of the hammermill. As indicated in FIGS. 4, 6 and 8, in the form shown each of the groups 130 of hammers 27 comprises eight of the hammers 27, four to be disposed on one side of the rotor center plate 92 and four to be disposed on the other side of the rotor center plate 92. The individual hammers 27 themselves may be of any type including the type that is to be fixedly mounted in the usual radially outwardly extending relation (and the hammer groups need not be subdivided, where the rotor is proportioned such that no center plate is desirable or necessary), though the hammers employed in a particular rotor should be the same for all groups and disposed and arranged for the usual mill application to a screen. Hammers of the type made by the assignee of the present invention, Prater Industrial Inc., of Chicago, Ill. are of the type well suited for application to the hammermill apparatus 10.

As indicated in FIGS. 3, 3A, 4, 6, and 8, the hammers 27 of each rotor group, in accordance with the present invention, are mounted on a pair of center tubes 140 and 142 on either side of the rotor center plate 92 that are held in place by a removable pin or rod 146 that is in slip fit relation within the respective tubes 140 and 142 and passes through the respective rotor plates 92, 94, and 96. The pins or rods 146 are removably mounted, with their respective ends 147 and 148 being held against displacement at the respective rotor plates 94 and 96 by a washer 150 (see FIG. 3) secured in place by suitable machine screw 152. In the case of each of the pins 146, a washer 150 and its securing screw 152 forms a hammer mounting pin securing device 154, with the devices 154 being applied to the respective rotor plates 94 and 96 at the location of each group 130 of hammers 27 to removably secure the mounting pin 146 thereof against dislodgement. The ends 147 and 148 (of the respective pins or rods 146) are each formed with a threaded aperture 155 to threadedly receive the respective screws 152, for reasons that are made clear hereinafter.

Again returning to FIGS. 4 and 6, it will be seen that the respective hammers 27 are apertured as at 157 adjacent their respective inner ends 156 to be received over the respective center tubes 140 and 142, for each group 130, and between the respective sleeves 158 that are mounted on the respective tubes 140 and 142 to space the hammers 27 of each group from each other as desired. The individual hammers 27 of each group 130 are to be conventionally proportioned so that their grinding outer ends 160 are in closely spaced relation with, and within, the screen 25.

Following conventional practice, the hammers 27 of each illustrated group 130 are swingably mounted at their respective ends 156 so that when the rotor 24 is at grinding speed, they extend under the centrifugal force involved to close adjacency with the screen 25. The hammers 27 of the respective groups 130 likewise may be arranged in accordance with any hammer pattern, about the rotor 24 to stagger the hammers of the respective groups 130 longitudinally of axis 28, in accordance with any suitable known practice of this type in this art. This patterning of the hammers 27 may also effect the length of the respective sleeves 158 since it is the sleeves 158 that separate the respective hammers 27 of the individual groups 130 on either side of the rotor from each other, with similar sleeves 159 being employed to separate or space the end hammers of each half group from the respective rotor plates 92, 94, and 96. It will also be noted that the hammer securement rods or pins 146 of each hammer group are located equidistantly from rotor axis 26.

It will thus be seen that when the hammermill door 42 is opened and swung to the out of way position of FIG. 3, the rotor 24 is fully exposed while remaining operably mounted within housing 12, with a hammer group securing device 154 for each of the hammer groups facing outwardly of the hammermill. When it is desired to change the hammers 27 making up the individual hammer groups 130, it is merely necessary to remove an outwardly facing securing device 154, namely its screw 152 and securing washer 150, apply the screw 152 to the threaded aperture 155 of rod or pin 146 (that is then facing outwardly of doorway or opening 40), draw the pin or rod 146 outwardly of opening 40 (and thus axially of the rotor 24, to detach for removal all of the hammers of the hammer group 130 being changed; as a pin or rod 146 of this particular group is being removed, the maintenance person making the hammer change can reach through the access doorway 40 and within the rotor 24 and grasp with one of his hands first the half group 130 that is on the far side of the rotor center plate 92, and when these are removed from the hammermill housing 12, then the other half group 130 (of hammers 27) that is on the near side of rotor center plate 92, while the rotor 24 remains mounted in housing 12 (as shown in FIG. 4). Thus, removal of the rotor 24 from housing 12 to change its hammers 27 is not necessary.

Of course, each group 130 of hammers 27 is removed and replaced one at a time. Mounting of the fresh group of hammers is effected by reversing the hammer removal operation, all with the hammermill rotor 24 and individual hammers as mounted for hammermill operation fully exposed to the worker by the relatively wide access doorway 40. It is a feature of the present invention that all of the hammer groups being replaced for a particular mill rotor 24 may be preassembled on a bench set up adjacent the mill to be serviced, so that worn hammer groups 130 may be quickly replaced with groups 130 of new hammers 27, thereby greatly reducing the mill down time.

As indicated in FIG. 4, the rotor 24 is journaled, for rotation about axis 26, on the housing back plate 14 (see FIG. 4). The rotor 24 in accordance with the present invention has a single bearing assembly 170 journaling it about its rotational axis 26. The journaling arrangement involved comprises bearing housing 172 that is sleeve-like in configuration and is suitably affixed to mounting plate 174, as by welding at 175. The hammermill housing back plate 114 is suitably apertured as at 176 to receive the bearing housing 172, with the bearing housing 172 being suitably affixed to the housing back plate within housing chamber 22 by suitable bolts 178. The aperture 176, of course, is centered on axis 26.

The bearing housing 172 suitably mounts rotor shaft 180, by way of suitable ball bearing units 182 and 184. In the form illustrated, the ball bearing unit 182 may be of any suitable type and is suitably held in place within housing 172 by cover assembly 186, and the bearing unit 184 is of any suitable type held in place by suitable cover assembly 188.

The rotor shaft 180 has a forwardly projecting end 190 that closely receives the hub 105 of the rotor 24. Rotor 24 is secured in place on the shaft 180 by securing bolt 192 applied within the threaded bore 194 of shaft 180, and acting against washer 196 which also holds the key 198 (see FIG. 3) that is inserted between the shaft end 190 and the rotor hub 102 in place. The slots of the rotor 24 and shaft 180 that receive the key 198 have been omitted to simplify the drawings.

The rotor shaft 180 at its other end 200 is slotted as at 202 to receive a suitable key for keying same to the conventional coupling 38 that is actuated by conventional motor 36 in accordance with standard practices.

The journaling of rotor 24 within its housing 12 illustrates another important feature of the invention Thus shaft 180 is to be as short and strong as reasonably possible to minimize overhang of same within chamber 22, and eliminate possible leverage for bending (and resulting vibration) during operation, while having the shaft (180) long enough to both journal it in the housing back wall 14 and approximately center the rotor 24 on the center of gravity of housing chamber 22. Thus, a major function of the short shaft 180 as journaled in housing 12 is to eliminate vibration and whipping of the shaft during mill operation, which makes for smoothness of operation of the mill 10.

While the size and operating capacity which the hammermill assembly may be made is optional, the drive motor for rotor 24 should rotate the rotor at least at a minimum speed of seven thousand feet per minute to achieve the normal size reduction expected for hammermills. This rpm may vary for different types of materials to be size reduced depending on how fragile or brittle the material to be reduced is, and how fine it is to be reduced. Currently motors of 900 rpm, 1210 rpm, 1810 rpm and 3600 rpm are available for operation of mill 10, but should any specific rpm be desired, this can be obtained using pulley belt and pulley arrangements and conventional technology to obtain the dimensioning that will provide the desired rpm. Of course, the mill 10 can be mechanized without any motor 36, coupling 38, or support 30, with the purchaser normally being capable of providing his own drive arrangement for the mill 10 he has acquired.

THE SCREEN

The screen 25 in accordance with the present invention comprise a pair of curvilinear screen sections or segments 210 and 212 (see FIG. 3), of which the screening for each defines the mesh size throughout to be employed for a particular hammermill assembly 10. The housing plates 14 and 16 have suitably fixed about the chamber 22 and coaxially of the axis 26 a pair of congruently related screen mounting rings 214 and 216 (see FIGS. 3–5), which are each of continuous annular configuration about chamber 22 and axis 26. The mounting rings 214 and 216 are proportioned to have an inner diameter that is substantially the same as the access opening 40 of front plate (see FIG. 6).

Contrary to conventional practices, the screen 25 has no cradle as such, with the screen sections 210 and 212 being applied directly to the inside surfacings 215 and 217, respectively defined by the internal diameters of the respective mounting rings 214 and 216, with screen section divider devices or assemblies 220, 222, and 224 being employed for this purpose (see FIGS. 3 and 5). Each of the devices 220, 222 and 224 comprises (see FIG. 7, which illustrates device 224) a screen divider plate 226 and a screen divider support plate 228 that is recessed as at 230 to closely receive the body 232 of the screen divider plate 226. The divider plate 226 and the support plate 228 therefor (of each of the devices 220, 222 and 224) extend the width of, and thus across, the chamber 22, with the screen divider plate 226 in each instance being formed with a pair of oppositely extending tapered lips 234 and 236 (see FIG. 7) and a pair of longitudinally extending grooves 235 and that extend the length of the respective plates 226. When the body 232 of the respective plates 226 is seated in the recess 230 of the respective support plates 230, the respective lips 234 and 236 define the respective tapering apertures 238 and 240, between the respective lips 234 and 236 and the respective end walls 242 and 244 (see FIG. 7) of the respective support plates 228.

In accordance with the present invention, the plates 226 and 228 of the lowermost device 220 (see FIGS. 3–5) are fixedly mounted in any suitable manner (using, for instance, welding techniques) between the hammermill housing rear back wall and front wall 16, this being done with the body 232 of plate 226 received in the recess 230 of mounting plate 228, which positions the assembly 220 to receive the respective lower ends 246 and 248 of the respective screen sections 210 and 212 within the tapered apertures 238 and 240 defined by the assembly 220, the assembly 200 being fixed to dispose the indicated apertures 238 and 240 aligned with the respective inner diameter surfacings 215 and 217 of the respective screen positioning rings 214 and 216.

As to the screen section securing assemblies 222 and 224, the support plate 228 thereof is formed with a pair of apertures 250 (see FIG. 4) to slidingly receive the respective rods 252 that are externally threaded at their outer ends 254, to threadedly receive a pair of long handle nut members 256 and 258 and that are suitably fixed to the respective divider plates 226 thereof at their respective ends 257. The support plates 228 of the assemblies 222 and 224 are fixed, as by employing welding techniques, between the respective housing plates 14 and 16 adjacent the respective screen mounting rings 214 and 216, with the respective rods 252 being of sufficient length to project through suitable apertures 259 formed in the respective side plates 18 and 20, and located to provide the relationship indicated in FIGS. 3, 5 and 7 when the assemblies 222 and 224 are in their respective operative positions. This permits the upper end 260 of the sleeve section 210 to be received in the slanted aperture 238 defined by the assembly 222, with the divider plate 226, to which the rods 252 are fixed, tightened against the support plate 228 (by appropriate threading action being taken on nuts 256 and 258) to mount and secure the screen section 210 within the rings 214 and 216 at that location of chamber 22. Similarly, the upper end 262 of the screen section 212 is applied to the tapered aperture 240 defined by the similarly arranged divider plate 226 and support plate 228 of the assembly 224, and its nuts 256 and 258 actuated to draw the divider plate in question against its support plate 228, to mount and secure the screen section 212 within the rings 214 and 216 at that location of the chamber 22 (the nuts 256 are to serve as lock nuts for anchoring the respective assemblies 222 and 224 in their operative positions).

A suitable material flow guide plate 270 (see FIG. 5) may be applied between the rings 214 and 216, the housing back or rear plate 214, the housing front plate 16, and the side plate 20. Similarly, a suitable material flow guide plate 272 (see FIG. 5) may be applied between the rings 214 and 216, the housing rear or back plate 14, the housing front plate 16, and the side plate 18 (using suitable welding techniques or the like with regard to the respective plates 270 and 272); the plates 270 and 272 are provided to define with the housing front and back plates 16 and 20 the inlet 50 of the housing 12 that is illustrated. Of course, other types of inlets to chamber 22 may be provided at the option of the mill user, in accordance with known practices in this field.

From the foregoing, it will be apparent that when the chamber 22 is opened by having the door 42 unlatched and swung to the position of FIG. 3, maintenance personnel in charge of the hammermill apparatus 10, may inspect and remove as needed, the groups 130 of hammers carried by the rotor 24, and with or without removing the rotor 24 from its drive shaft 180. Normally, all the hammer groups 130 of the rotor are replaced at the same time by maintenance personnel, and for this purpose the rotor 24 need not be removed, and the fresh groups 130 may be preassembled, as on a bench adjacent mill 10. The person changing out the groups 130, for each group 130, removes the securing device 154 therefor that faces him (when the door 42 is open), and following the procedure previously indicated, apply the screw 152 of such device 154 to the aperture 155 of the rod 14 that secures the hammer group in place, withdraw such rod 146 to release for hand removal the hammers 27 and associated parts (see FIG. 7) secured to the rotor 24 by a hammer group pin 146, after which fresh hammers 17 and associated parts are secured in place by reversing the procedure and resecuring the indicated device 154 in place.

Also, the screen sections 210 and 212 may be inspected, and replaced as needed, by loosening the respective securement devices 222 and 224 that clamp the upper ends 260 and 262 of the respective screen sections 210 and 212 to the respective mounting rings 214 and 216, manually removing the screen section or sections that need to be replaced, and remounting the screen segments in their operative positions of FIG. 5, by sliding the fresh respective screen sections into place within the rings 214 and 216 and between the divider plate 226 and divider support plate 228 of the lower assembly 220. The divider plates 226 of the upper assemblies 222 and 224 then are drawn against the respective support plates 228 of such assemblies, to clamp the upper ends 260 and 262 of the respective screen sections 210 and 212 against the respective screen mounting rings 214 and 216, all without the need of removing or disconnecting rotor 24 from its shaft 180.

Where it is desired to remove the rotor 24, this can be done by removing the bolt 192 to permit rotor 24 to be separated from shaft 180, and of course the rotor 24 or its rotor replacement may be made fast to shaft 180 by reversing the indicated removal procedure.

Upon closing the hammermill housing single access door 42 to close off the access doorway 40 and actuating latch device 48 to lock the door 42 in the operating position of the hammermill apparatus 10, the hammermill apparatus 10 may be actuated by appropriately energizing the operating motor 36 and supplying from a suitable overhead mounted feeder or the like the material to be sized by the hammermill apparatus 10. Such material drops into the hammermill chamber 22 and into the rotor 24 between the respective groups 130 of hammers 27. As the hammermill apparatus 10 continues to operate, the material being reduced in size is thrown back and forth between the rotor and the screen dividers, which results in the material being thrown against the screen sections 210 and 212 for grinding application thereto of the rotating groups of hammers 27. The sized material passes through the mesh defined by screen segments and drops through the housing outlet 50 into conventional handling equipment for carrying away to an appropriate location for packaging, further processing, etc.

The showing of FIG. 5 is indicative of the particulate material movement within the rotor 24 for drive rotation in a counterclockwise direction. The arrows indicate the basic material flow pattern involved, with the screen section divider devices 220, 222 and 224 each contributing to impacts and change of movement direction that are involved when mill 10 operates. Thus, as indicated in FIGS. 3 and 7, the particulate material is thrown radially inwardly by the divider plate upstream flanges (236 in the showing of FIGS. 5 and 7) and the grooves 235 and 237, for reverse rotation of rotor 24, the turbulent action is similar but involves the opposite flanges (for instance flange 234) of the devices 220, 222 and 224.

The result is that the material being sized is subject to multiple impacts and turbulence within rotor 24 when mill 10 operates, for decreasing the time needed to size particulate material being processed by mill 10.

It will therefore be apparent that the hammermill arrangement of this invention is characterized by ease of operation and maintenance, with minimumized down time and considerably lower operating costs than conventional hammermills as well as higher capacity capability and energy efficiency. The arrangement of the apparatus for fully exposing the rotor 24, the groups of hammers 27 carried thereby, and the hammermill screen sections 212 and 214 on opening of the hammermill door 42, to the position in which it fully opens the hammermill access opening 40, and the particular mounting of the rotor hammers that is employed, allows changes of hammers and screen sections to be rapidly made without removing the rotor from its mounted position within the hammermill apparatus 10. Further, the screen 25 employed in the hammermill apparatus 10 requires no cradle and is self tightening during grinding (as the grinding action involved and the airflow generated by rotation of rotor 24 is against the screen 25).

Also, the hammers 27 may be quickly changed, group by group, without requiring removal of the rotor.

Of further significance is that having the hammermill housing in essentially a one piece welded housing keeps the dust within the hammermill housing, with the housing back and side plates that define the housing chamber 22 being imperforate in nature, as is the portion of the housing front plate that defines the housing chamber 22 about access opening 40. The symmetrical arrangement of the rotor avoids undesirable vibration without extensive machining. The housing having relatively thick and heavy walls as well as its compact construction reduces noise levels.

As also indicated, the hammermill apparatus 10 in having its back or rear wall 14 serve as the main wall for the hammermill housing, permits crane lift movement of same when the housing is equipped with the mill and motor base 30 and a change of hammermill location is desired.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a hammermill that includes a housing defining a hammermill chamber having a center of gravity, an inlet thereto and an outlet therefrom, a rotor journaled in the housing centrally of the housing hammermill chamber for rotation about an axis that extends substantially normally of the chamber, a screen mounted within the housing radially outwardly of the rotor, with the rotor mounting a plurality of hammers hammermill style and disposed in groups spaced circumferentially of the rotor, with the hammers of each group of hammers having a common pivot axis that extends transversely of the rotor and said pivot axes being spaced equidistantly radially outward of the rotor axis, and with the hammers each being proportioned lengthwise thereof for hammermill style cooperation with the screen on rotation of said rotor, and with the rotor being rotatable about its journaling axis for grinding and screening through the screen for passage to the housing outlet material to be reduced in size that is introduced into the housing inlet, the improvement wherein:

the housing comprises front, rear and side plates, with said front and rear plates extending normally of the rotor and hammer axes, said plates being fixed together by bonding means for forming the chamber and for effecting the sealing off of dust emission between same on operation of the hammermill, with the portions of said rear and side plates defining the chamber being imperforate for precluding dust emission therethrough on operation of the hammermill, said rotor being journaled in said housing rear plate to the exclusion of said front plate for rotation about the rotor axis, said rotor being symmetrical about the rotor axis, with the housing front plate being open coextensively with the radial dimensioning of the rotor and the screen, relative to the rotor axis, to define access opening in the housing to the rotor and screen, said access opening being centered on the rotor axis, and when open exposing one side of said rotor, with the portion of said front plate defining the chamber being imperforate about said access opening for precluding dust emission therethrough on operation of the hammermill, a door proportioned and constructed to close off said access opening in the closed position of said door with respect to said access opening, hinge means for hinging said door to said housing for swinging said door about a vertical axis between said closed position and an open position wherein said screen and rotor are fully exposed through said access opening in the open position of said door, means for fixing said door across said housing access opening to close off said housing chamber on operation of the hammermill, the pivot axis of each of said hammer groups being defined by a pin, a center tube slip fit mounted on each of said pins on which the hammers of the respective groups are journaled in spaced apart relation longitudinally of the hammer group pivot axis, with said pins being disposed in substantial parallelism with the rotor rotational axis and presenting like ends at said one side of the rotor, and including locking means for locking said like ends of said pins to said rotor against withdrawal from the rotor, for rotation of said pins therewith on operation of said hammermill, including means for releasing and locking said locking means that is operable from said one side of said rotor, whereby, when the hammermill rotor rotation is discontinued and said door is removed from said access opening to expose the hammermill rotor said one side, the individual groups of hammers may be manually replaced through said housing access opening by, for each of the respective hammer groups, operating said release means of said pin thereof, manually removing said pin thereof followed by manual removal such hammer group itself, replacing such hammer group with a preassembled fresh hammer group like arrangement, replacing said pin to operably mount the preassembled hammer group in the rotor, and locking said locking means for locking such pin to the rotor, the rotor comprising:

a center plate, and a pair of side plates on either side of said center plate and equally spaced therefrom, said center plate comprising a radially inner hub portion and a radially outer rim portion, with said center plate portions being in fixed relation, said side plates both being of open center configuration defining annular rings that are substantially congruent with said center plate rim portion, said one end of said shaft being keyed to said center plate hub portion for keying said shaft to the rotor, and with said pins extending between said side plates and said center plate rim portion, one of said side plates defining said one side of the rotor, and with the other side of the rotor being adjacent said rear plate, said bearing extending from said rear plate toward said access opening to adjacent the plane of said center plate hub portion in telescoping relation to the rotor.

2. In a hammermill that includes a housing defining a hammermill chamber having a center of gravity, an inlet thereto and an outlet therefrom, a rotor journaled in the housing centrally of the housing hammermill chamber for rotation about an axis that extends substantially normally of the chamber, a screen mounted within the housing radially outwardly of the rotor, with the rotor mounting a plurality of hammers hammermill style and disposed in groups spaced circumferentially of the rotor, with the hammers of each group of hammers having a common pivot axis that extends transversely of the rotor and said pivot axes being spaced equidistantly radially outward of the rotor axis, and with the hammers each being proportioned lengthwise thereof for hammermill style cooperation with the screen on rotation of said rotor, and with the rotor being rotatable about its journaling axis for grinding and screening through the screen for passage to the housing outlet material to be reduced in size that is introduced into the housing inlet, the improvement wherein:

the housing comprises front, rear and side plates, with said front and rear plates extending normally of the rotor and hammer axes, said rotor being journaled in said housing rear plate by journaling means to the exclusion of said front plate for rotation about the rotor axis, said rotor being symmetrical about the rotor axis, with the housing front plate being open coextensively with the radial dimensioning of the rotor and the screen, relative to the rotor axis, to define access opening in the housing to the rotor and screen, said access opening being centered on the rotor axis, and when open exposing one side of said rotor, a door proportioned and constructed to close off said access opening in the closed position of said door with respect to said access opening, hinge means for hinging said door to said housing for swinging said door about a vertical axis between said closed position and an open position wherein said screen and rotor are fully exposed through said access opening in the open position of said door, means for fixing said door across said housing access opening to close off said housing chamber on operation of the hammermill, said journaling means comprising:

a cylindrical bearing mounted in said housing rear plate coaxially of the rotational axis and extending inwardly of the chamber and outwardly of the housing said rear plate, said bearing extending inwardly of the chamber from said rear plate toward said access opening to adjacent the chamber center of gravity in telescoping relation to the rotor, a shaft journaled in said bearing coaxially of the rotor rotational axis and having one end of same extending into the housing chamber toward the chamber center of gravity, and means for keying the rotor to said shaft one end with the rotor being approximately centered on the chamber center of gravity, said other end of said shaft including means for connecting same to a source of rotational power for rotating said shaft and said rotor about the rotational axis, whereby the resulting short overhang of said shaft one end between said bearing and said rotor is proportioned for minimization of shaft bending and consequent vibration during rotation of the rotor for hammermill grinding and screening of such material.

3. The hammermill improvement set forth in claim 2 wherein, said housing rear plate is proportioned to comprise the main wall for the housing, and including, power means for rotating the rotor, said housing including a base structure on which said power rotating means is operably mounted for coupling to said rotor for rotating same, with the housing including the rotor, said base structure, and said rotating means essentially balancing the hammermill on either side of said housing rear plate, with the housing rear plate exteriorly of the chamber including aperture means for crane hoisting the hammermill for shifting the position of same.

4. The hammermill improvement set forth in claim 2 wherein:

said hinge means comprising a single hinge device operably connected to the housing to one side of said access opening and including a hinge member hingedly mounted said door for swinging movement about said vertical axis, said hinge member being elongate lengthwise of said vertical axis thereof, said hinge member being disposed approximately at the level of the lower half of said access opening, and including:

a rigid reinforcing member bonded to said door and proportioned to extend diametrically across said door with one end portion thereof made fast to said hinge member, and means for making the other end portion of said reinforcing member fast to the housing when said door is swung to said closed position.

5. The hammermill improvement set forth in claim 4, including:

a gusset made fast between said hinge member, said door, and said reinforcing member.

6. The hammermill improvement set forth in claim 2 wherein:

the screen is in sections removably mounted within the housing, the inner surfacings of the housing said front and rear plates each have fixed to same, in congruent, spaced apart relation, and centered on the rotational axis, annular rings of substantially equal distance, with said screen sections being fitted within said rings to form the screen, and means for securing said screen sections within and against said rings for mounting same within the housing, whereby, when the hammermill rotor rotation is discontinued, said door is removed from said access opening to expose the hammermill rotor and screen, and said screen sections are released, said screen sections may be individually replaced through said housing doorway free of removing the rotor.

7. The hammermill improvement set forth in claim 6 wherein:

said screen sections are two in number, and at the lower portion of the chamber sequential ends of said screen sections are removably secured to the housing within said rings adjacent each other, said securing means including adjustable clamping means at the upper portion of the chamber for adjustably clamping the other screen section ends in spaced apart relation for securing the screen within the housing.

8. The hammermill improvement set forth in claim 7 including:

plate means extending across the respective screen section ends for deflecting material being sized back into the rotor for throwing against the screen when the hammermill rotor is rotated.

9. In a hammermill that includes a housing defining a hammermill chamber having a center of gravity, an inlet thereto and an outlet therefrom, a rotor journaled in the housing centrally of the housing hammermill chamber for rotation about an axis that extends substantially normally of the chamber, a screen mounted within the housing radially outwardly of the rotor, with the rotor mounting a plurality of hammers hammermill style and disposed in groups spaced circumferentially of the rotor, with the hammers of each group of hammers having a common pivot axis that extends transversely of the rotor and said pivot axes being spaced equidistantly radially outward of the rotor axis, and with the hammers each being proportioned lengthwise thereof for hammermill style cooperation with the screen on rotation of said rotor, and with the rotor being rotatable about its journaling axis for grinding and screening through the screen for passage to the housing outlet material to be reduced in size that is introduced into the housing inlet, the improvement wherein:

the housing comprises front, rear and side plates, with said front and rear plates extending normally of the rotor and hammer axes, said rotor being journaled in said housing rear plate to the exclusion of said front plate for rotation about the rotor axis, said rotor being symmetrical about the rotor axis, with the housing front plate being open coextensively with the radial dimensioning of the rotor and the screen, relative to the rotor axis, to define access opening in the housing to the rotor and screen, said access opening being centered on the rotor axis, and when open exposing one side of said rotor, a door proportioned and constructed to close off said access opening in the closed position of said door with respect to said access opening, hinge means for hinging said door to said housing for swinging said door about a vertical axis between said closed position and an open position wherein said screen and rotor are fully exposed through said access opening in the open position of said door, means for fixing said door across said housing access opening to close off said housing chamber on operation of the hammermill, the pivot axis of each of said hammer groups is defined by a pin, a center tube slip fit mounted on each of said pins on which the hammers of the respective groups are journaled in spaced apart relation longitudinally of the hammer group pivot axis, with said pins being disposed in substantial parallelism with the rotor rotational axis and presenting like ends at said one side of the rotor, and including locking means for locking said like ends of said pins to said rotor against withdrawal from the rotor, for rotation of said pins therewith on operation of said hammermill, including means for releasing and locking said locking means that is operable from said one side of said rotor, whereby, when the hammermill rotor rotation is discontinued and said door is removed from said access opening to expose the hammermill rotor said one side, the individual groups of hammers may be manually replaced through said housing access opening by, for each of the respective hammer groups, operating said release means of said pin thereof, manually removing said pin thereof followed by manual removal such hammer group itself, replacing such hammer group with a preassembled fresh hammer group like arrangement, replacing said pin to operably mount the preassembled hammer group in the rotor, and locking said locking means for locking such pin to the rotor.

10. In a hammermill that includes a housing defining a hammermill chamber having a center of gravity, an inlet thereto and an outlet therefrom, a rotor journaled in the housing centrally of the housing hammermill chamber for rotation about an axis that extends substantially normally of the chamber, a screen mounted within the housing radially outwardly of the rotor, with the rotor mounting a plurality of hammers hammermill style and disposed in groups spaced circumferentially of the rotor, with the hammers of each group of hammers having a common pivot axis that extends transversely of the rotor and said pivot axes being spaced equidistantly radially outward of the rotor axis, and with the hammers each being proportioned lengthwise thereof for hammermill style cooperation with the screen on rotation of said rotor, and with the rotor being rotatable about its journaling axis for grinding and screening through the screen for passage to the housing outlet material to be reduced in size that is introduced into the housing inlet, the improvement wherein:

the housing comprises front, rear and side plates, with said front and rear plates extending normally of the rotor and hammer axes, said rotor being journaled in said housing rear plate to the exclusion of said front plate for rotation about the rotor axis, said rotor being symmetrical about the rotor axis, with the housing front plate being open coextensively with the radial dimensioning of the rotor and the screen, relative to the rotor axis, to define access opening in the housing to the rotor and screen, said access opening being centered on the rotor axis, and when open exposing one side of said rotor, a door proportioned and constructed to close off said access opening in the closed position of said door with respect to said access opening, hinge means for hinging said door to said housing for swinging said door about a vertical axis between said closed position and an open position wherein said screen and rotor are fully exposed through said access opening in the open position of said door, means for fixing said door across said housing access opening to close off said housing chamber on operation of the hammermill, a cylindrical bearing mounted in said housing rear plate coaxially of the rotational axis and extending inwardly of the chamber and outwardly of the housing said rear plate, a shaft journaled in said bearing coaxially of the rotor rotational axis and having one end of same extending into the housing chamber toward the chamber center of gravity, and means for keying the rotor to said shaft one end with the rotor being approximately centered on the chamber center of gravity, said other end of said shaft including means for connecting same to a source of rotational power for rotating said shaft and said rotor about the rotational axis, whereby the resulting short overhang of said shaft one end between said bearing and said rotor is proportioned for minimization of shaft bending and consequent vibration during rotation of the rotor for hammermill grinding and screening of such material, with the rotor comprising:

a center plate, and a pair of side plates on either side of said center plate and equally spaced therefrom, said center plate comprising a radially inner hub portion and a radially outer rim portion, with said center plate portions being in fixed relation, said side plates both being of open center configuration defining annular rings that are substantially congruent with said center plate rim portion, said one end of said shaft being keyed to said center plate hub portion for keying said shaft to the rotor, and with said pins extending between said side plates and said center plate rim portion, one of said side plates defining said one side of the rotor, and with the other side of the rotor being adjacent said rear plate, said bearing extending from said rear plate toward said access opening to adjacent the plane of said center plate hub portion in telescoping relation to the rotor.

11. The hammermill improvement set forth in claim 10 wherein, said housing rear plate is proportioned to comprise the main wall for the housing, and including, power means for rotating the rotor, said housing including a base structure on which said power rotating means is operably mounted for coupling to said rotor for rotating same, with the housing including the rotor, said base structure, and said rotating means essentially balancing the hammermill on either side of said housing rear plate, with the housing rear plate exteriorly of the chamber including aperture means for crane hoisting the hammermill for shifting the position of same.

* * * * *